US005606876A

United States Patent [19]

Sangiacomo

[11] Patent Number: 5,606,876

[45] Date of Patent: Mar. 4, 1997

[54] DEVICE FOR HANDLING KNITTED PRODUCTS MANUFACTURED ON CIRCULAR STOCKING KNITTING MACHINES

[75] Inventor: Fulvio Sangiacomo, Brescia, Italy

[73] Assignee: Sangiacomo S.P.A., Brescia, Italy

[21] Appl. No.: 426,704

[22] Filed: Apr. 24, 1995

[30] Foreign Application Priority Data

Apr. 26, 1994 [IT] Italy ..... BS94A0042
Sep. 9, 1994 [IT] Italy ..... BS94A0100

[51] Int. Cl.[6] ..... D04B 9/40

[52] U.S. Cl. ..... 66/148; 66/147

[58] Field of Search ..... 66/147, 148, 149 R, 66/150, 151, 152, 153, 149.5; 112/470.15

[56] References Cited

U.S. PATENT DOCUMENTS 3,550,403 12/1970 Shields ..... 66/153
4,028,910 6/1977 Wignall et al. ..... 66/148
5,127,558 7/1992 Paolo ..... 66/147
5,157,946 10/1992 Egea et al. ..... 66/148

*Primary Examiner*—C. D. Crowder
*Assistant Examiner*—Larry D. Worrell, Jr.
*Attorney, Agent, or Firm*—McGlew and Tuttle

[57] ABSTRACT

A process and device for picking up and transferring stockings from a stocking circular knitting machine to a sewing machine for closing the toe of the stockings. The device includes conveying units for taking hold of the stocking at two opposite zones of the knitted fabric at a level of the open toe. Structure for moving the stocking is provided between a position for picking up the stocking, within the circular machine, in a position outside of the circular machine. A holding structure is provided for taking hold of the stocking from the conveying units and maintaining a hold on the stocking for positioning the stocking with respect to the sewing machine, for closing the toe. The method is based on the steps of mechanically removing the stocking from the sewing machine based on picking up the stocking at two diametrically opposite locations and supporting the opposite parts during transfer, bringing the edges of the open toe together for sewing the toe edge.

17 Claims, 11 Drawing Sheets

17
16
18
11
12'
12
10
14
15
20
13
24
21
30
30
22
24
23
21
24

DEVICE FOR HANDLING KNITTED PRODUCTS MANUFACTURED ON CIRCULAR STOCKING KNITTING MACHINES

FIELD OF THE INVENTION

The present invention concerns the manufacture of stockings (stock, hose) on circular stocking knitting machines, especially stockings for men, women, and children, sports-type and nonsports-type stockings, tight-fitting stockings, and the like. More particularly, the present invention is aimed at a process and a device for the automatic handling of stockings up to the closing of their toe.

BACKGROUND OF THE INVENTION

Usually, stockings are manufactured on the circular stocking knitting machines by starting from the edge or cuff and ending in the toe which remains open and which must be closed later by means of sewing outside of the circular machine. In general, the knitting of each stocking on the circular machine is finished, continuously to the open toe, with a so-called unthreading, that is, with one stitch end to be dropped, preceded by a decrease or by an increase in the stitch, which forms a reference and guiding means for the stocking at the time of the closing of the toe on a sewing machine, a so-called seam cutter. In practice, each stocking, when it is finished and unloaded from the circular machine with which it was produced, is turned inside out, so that the closing seam remains on the inside of the stocking. The stocking is then picked up again to bring together the edges of its open toe and to introduce it into the sewing machine, which must perform the closing seam of the toe. The handling and the introduction of each stocking into the sewing machine is still done manually at the present time.

What is certain is that the closing of the stockings by sewing the toe outside the knitting machines involves a variety of additional operations, a considerable use of labor and therefore considerable times and work loads, which have an effect on the cost of the manufactured products by increasing it. For these reasons, a search has been made over time for a system, which permits the closing of the toe of the stockings outside the knitting machine and which, however, limits the necessary operations and minimizes the use of labor in order to cut down the relative costs.

SUMMARY AND OBJECTS OF THE INVENTION

The object of the present invention is specifically to propose a process and a device which makes possible an effective solution to the above-mentioned problem in a particularly simple and effective manner, especially without having an effect on the traditional structure of the machine and on the usual process of manufacturing the stockings.

Another object of the present invention is to propose a device for carrying out such a process effectively and with reliability without significantly modifying the technical and productive features of the circular stocking knitting machine, with which it is used, and with both productive and economic advantages.

Still another object of the present invention is to provide a device capable of automating both the pickup of each stocking from the circular machine, with which it is manufactured starting from the edge or cuff and ending at the open toe, and the transfer of the same stocking to a sewing machine for the closing of the toe, thus eliminating the need for labor, storage and reworking of the manufactured products, as well as the space and the costs implicated by the prior-art techniques.

For this purpose, the present invention proposes a process for picking up and transferring the stockings from a stocking knitting machine to a sewing machine for the closing of the toes of the stockings, according to which process each stocking, at the end of its manufacturing, which ends in the open toe, is mechanically removed from the machine by being picked up from needles in two diametrically opposite parts, it is supported in these two opposite parts, and it is transferred to a sewing machine (seam cutter) after the edges of the open toe to be sewn have been brought together for its closing.

According to a first embodiment of the process, each stocking is picked up mechanically and extracted below the cylinder of the machine by passing through a suitable pulling device of the machine.

Each stocking is picked up and extracted above the cylinder according to another embodiment.

The pickup of each stocking from the needles of the cylinder is carried out with the passage of at least two diametrically opposite stitch points from at least two respective needles to two mechanical conveying units, then with the unloading of all stitch points from the needles of the cylinder and the removal of the units conveying the stocking from the cylinder, the units being in an inactive position during the manufacture of the stocking and being brought into an active position to pick up the stocking at the end of its manufacture.

The bringing together of the edges of the open toe to be sewn is carried out with means intended for taking hold of the stocking by two opposite parts adjacent to the conveying units, these units being released from the stocking after the stocking has been taken hold of by the taking hold means and, however, before the stocking is introduced into the sewing machine.

The present invention also proposes a device for picking up and transferring a stocking with open toe from a circular stocking knitting machine, with which the stocking was manufactured, to a sewing machine for the closing of the toe of the stocking, which device comprises:

- conveying units intended for taking hold of the stocking in at least two opposite zones of its knitted fabric at the level of the open toe before the stocking is unloaded from the needles, with which it was manufactured,
- means for a movement of the conveying units between a position of picking up the stocking in the circular machine and a position outside the machine, and
- holding means for taking hold of the stocking from the conveying units, when these units are in the position outside the circular machine, for bringing the edges of the open toe of the stocking together and keeping them tightly close together and for positioning the stocking with respect to the sewing machine for the closing of the toe.

The device proposed here starts operating after the formation of the toe of the stocking and of a relative, usual "unthreading" of its end, therefore without interfering with the normal manufacture of the stocking carried out by the circular machine.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
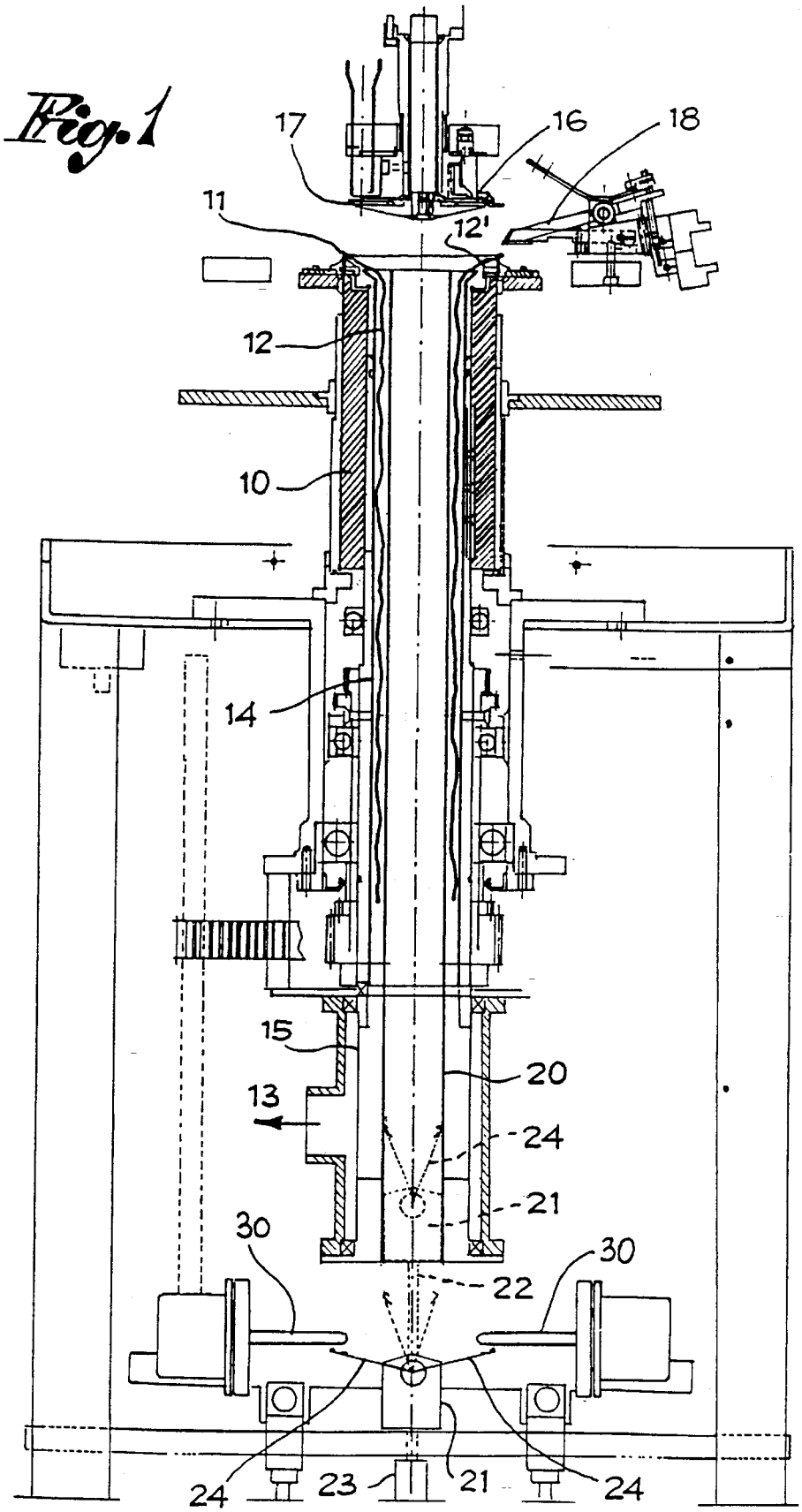
FIG. 1 is a schematic view, in vertical section, of a circular stocking knitting machine incorporating a device according to the present invention for the pickup of each stocking produced from the bottom, the device being shown, in solid lines and in partial section, in a lowered, inactive position and, with dashed lines, in an ascending position along the cylinder of the machine.

In these drawings, the cylinder of a circular stocking knitting machine is indicated by 10, and it has needles 11 for manufacturing a stocking 12. Each time, the manufacture starts from its edge or cuff until ending in the toe 12' (finished with "unthreading"), which remains open. A pneumatic, anti-twist-type pulling system 13, which is known in itself, consisting of an outer tube 14 and of a perforated basket 15, capable of tensioning the knitting gradually produced on the circular machine, extends into the cylinder 10. Arranged above the cylinder 10 is a small plate 16 carrying the needles or radial hooks 17, which are able to interact with the needles 11 on the cylinder for the usual operations, the small plate is provided with moving means such that it is able to be shifted in height above the cylinder.

A thread guide 18 is also shown at the top of the cylinder 10 only by way of illustration in FIG. 1.

When the manufacture of the stocking 12 is completed at the level of the open toe 12', the stocking is mechanically removed from the needles 11 and is transferred, outside of the circular machine, to a sewing machine 19 (see FIGS. 6 and 16) for the closing of the open toe 12'.

In an embodiment of the present invention, the stocking 12 is removed and extracted towards the bottom from the inside of the cylinder 10. For this purpose, a central guide tube 20 for a unit 21 for picking up and extracting the stocking is arranged concentrically in the outer tube 14 of the pneumatic pulling system 13. The unit 21 can be moved vertically in the central tube 20 from the bottom to the top and vice versa, and it can be extracted below the same tube. For such movements thereof, the unit 21 is arranged, for example, at the end of the rod 22 of a pneumatic, double-acting piston, axially to the central tube 20.

The unit 21 has at least two diametrically opposite conveying units 24 intended for picking up the stocking from the needles on the cylinder of the circular machine. The conveying units 24 may be in the form of latch type needles, as shown in the drawings, or piston type needles, hooks, or the like. The opposite conveying units 24 can be moved at angles, above the unit 21, on an axis of rotation 25 from a position, in which they are brought together and in which they are in the profile of the unit 21 to be able to pass with this unit in the central tube 20, to a position in which they are pulled apart.

Figure 5:
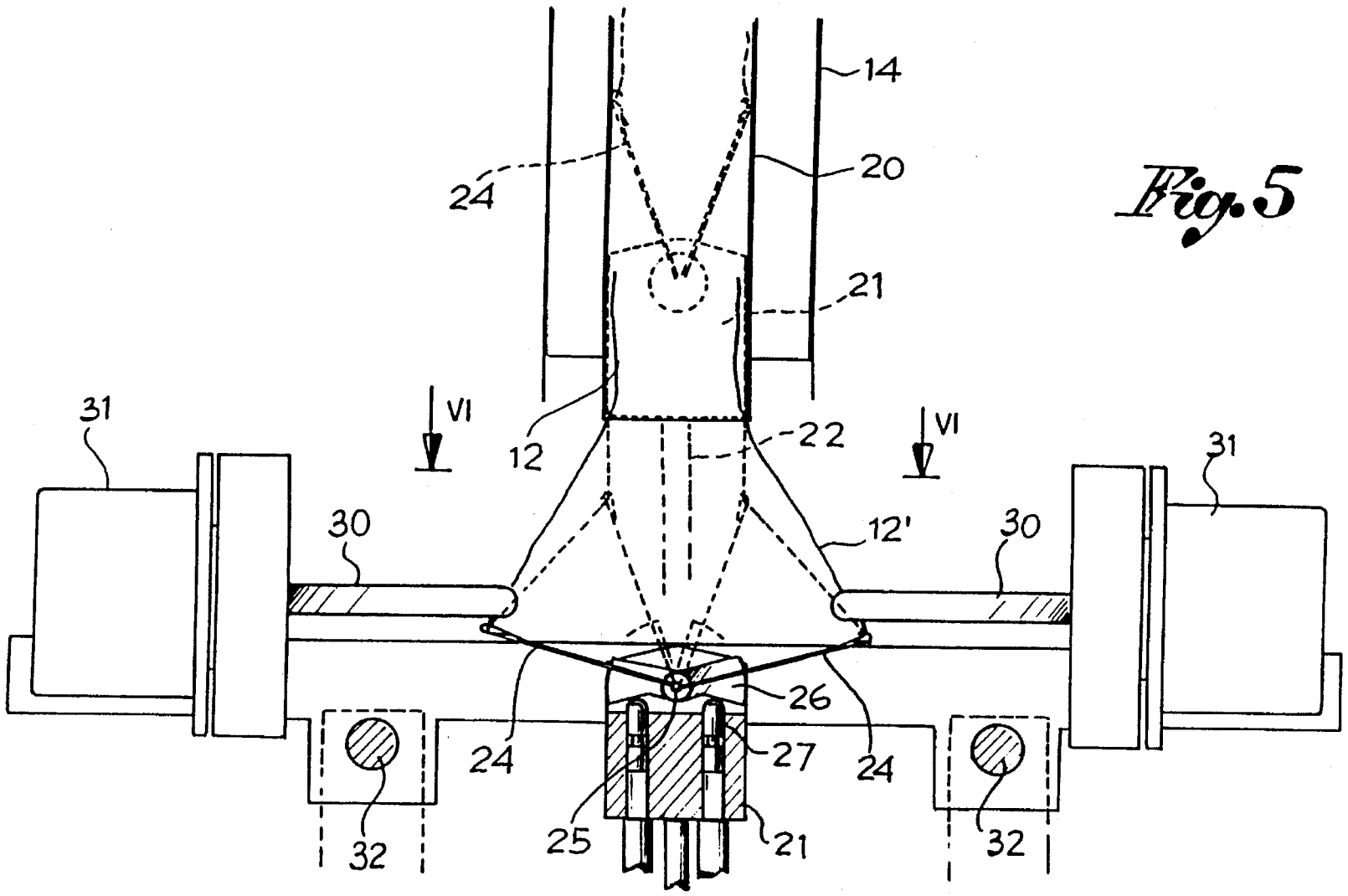
FIG. 5 is a schematic partially sectional view showing the pickup device lowered, with the stocking attached to it, turned inside out and being held by a conveying unit.
Figure 8:
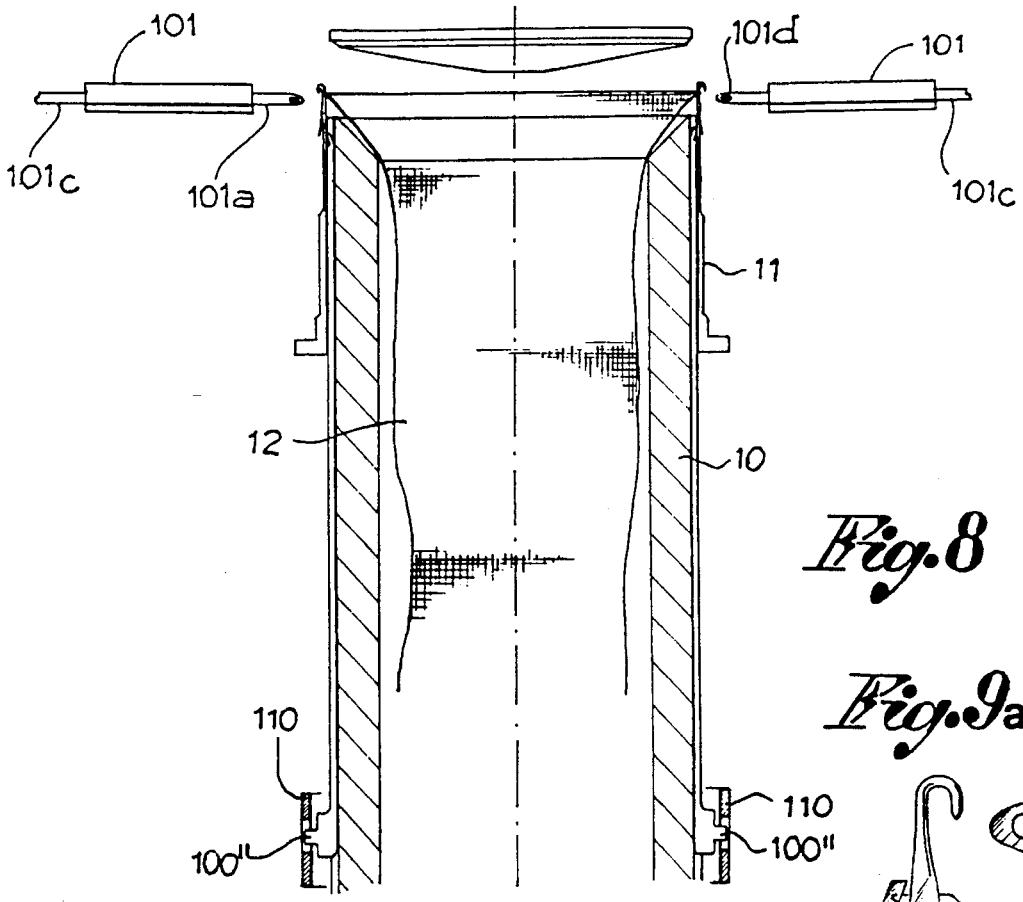
FIG. 8 is a schematic vertical sectional view according to the line VIII—VIII in FIG. 7 of the cylinder with the associated pickup device.

For this purpose, the conveying units 24 are mounted on the unit 21 by means of support elements 26, which oscillate on the axis 25 and can be moved by means of pistons 27 (see FIG. 5).

During the manufacture of the stocking 12 on the circular machine, the pickup unit 21 is in a lowered position, and the knitted fabric, by means of pulling, is unfolded in the outer tube 14, between this tube and the central tube 20 (see FIG. 1).

Figure 2:
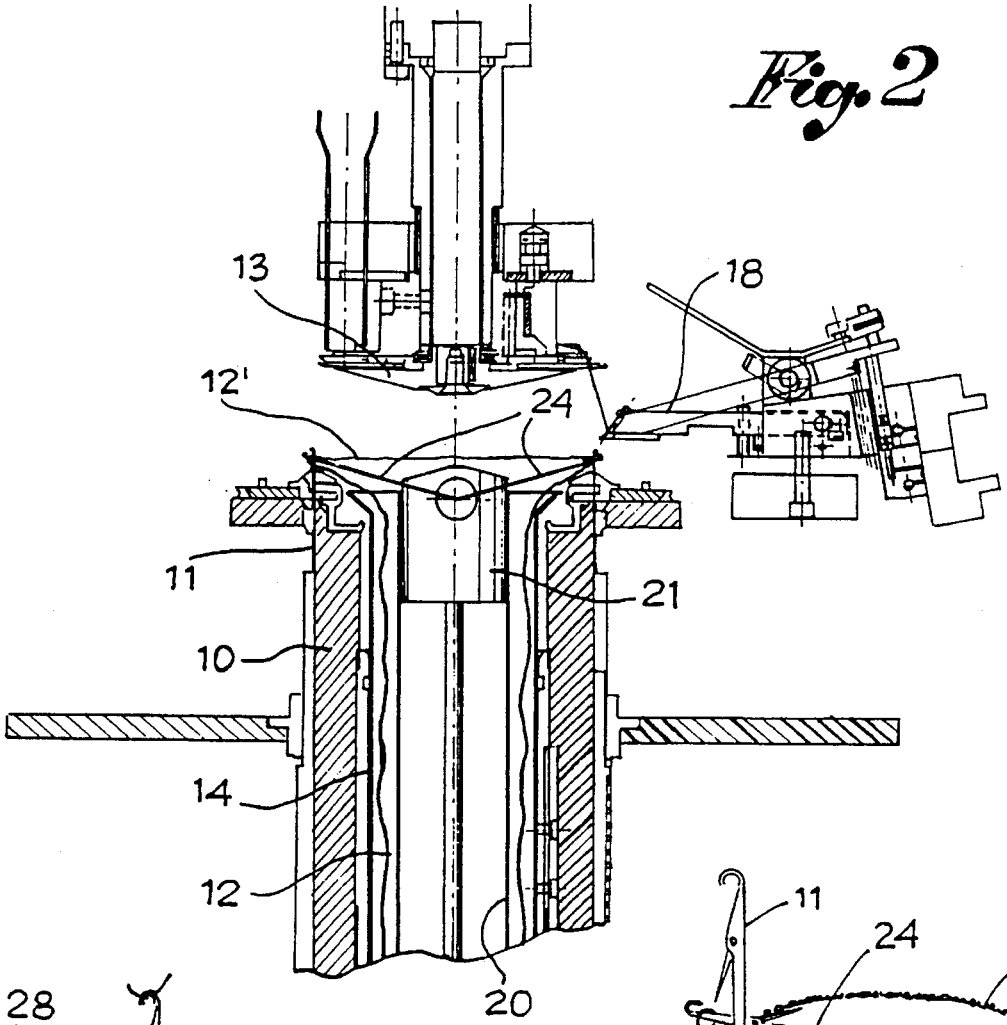
FIG. 2 is a sectional view of the device in the raised position for the pickup of the stocking from the needles of the cylinder of the machine.

Once the stocking 12 is completed, the pickup unit 21 is moved upwards up to the top of the cylinder, and the conveying units 24 are pulled apart to pick up the knitting from the needles of the cylinder (see FIG. 2) throughout one or more rows of knitting. A puff of air coming from a small opening 28 ensures the opening of the latch of the conveying units 24 when these conveying units 24 are latch type needles.

Figure 3A:
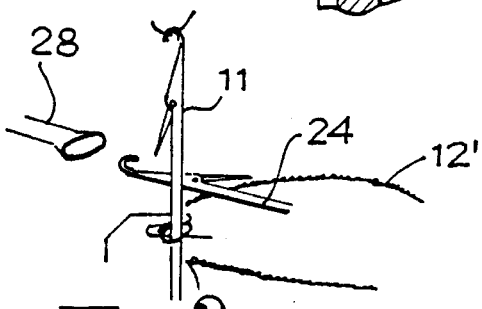
FIGS. 3*a, b, c, d* are schematic perspective views which show, in sequence, some phases of the transfer of the knitting from the needles of the cylinder to the pickup device.
Figure 3C:
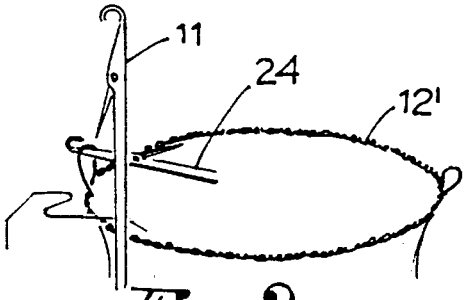
Figure 3B:
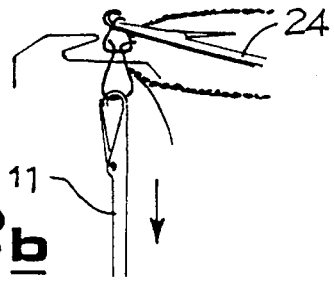
Figure 3D:
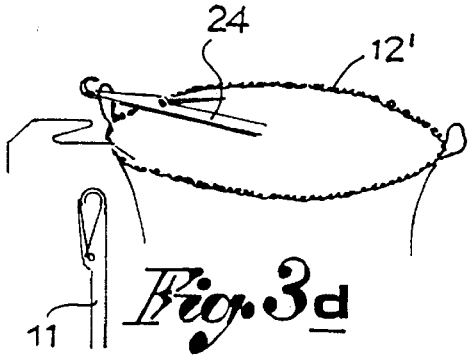

A method of transferring the knitting from the needles of the cylinder to the pickup elements is schematically shown in FIGS. 3*a, b, c*, and *d*.

While the "unthreading" of the toe of the stocking is being carried out, some of the needles 11 of the cylinder are raised up to the knitting to be unloaded and are then lowered to unload the knitting and to leave the manufactured product on the conveying units 24. This method itself is known by the person skilled in the art.

Figure 4:
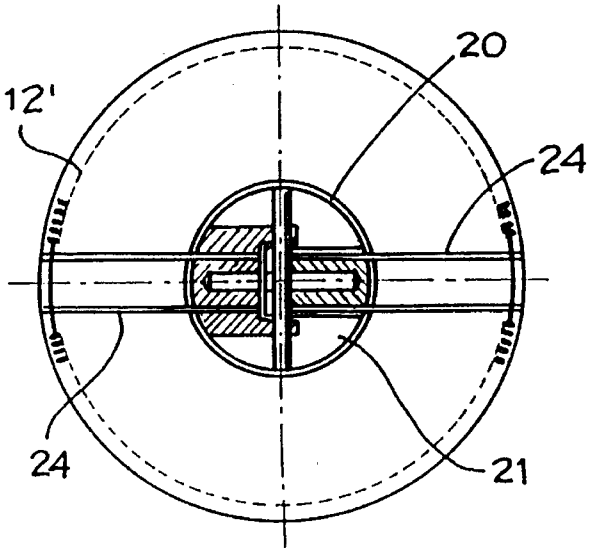
FIG. 4 is a top view of the device in the position in FIG. 2.

The stocking 12 is then unloaded from all the needles of the cylinder and thus remains supported by the conveying units 24 in two diametrically opposite zones (see FIG. 4).

At that point, the conveying units 24 are brought together at the center, and the unit 21 is led towards the bottom by means of the piston 23 up to the outside of the central tube 20, dragging along the stocking and turning it inside out as in FIG. 5.

When the pickup unit 21 is outside of the guide tube 20. The pickup unit 21 can be moved as desired and comes to lie at the level of a pair of opposite pincers 30, intended for taking hold of the stocking from the conveying units 24 and for transferring it to the sewing machine 19. The pincers 30 are provided with rotary movement around their own axis, which movement is controlled by a servomotor or by another servo control 31. The pincers 30 are conducted on guide means, and they can be moved on these means, e.g., with the pistons for carrying each stocking up to the sewing machine (see FIGS. 5 and 6).

In particular, the conveying units 24 are pulled apart again so as to diametrically stretch out the stocking in the part of the toe 12' in order to bring the two edges of the open toe close to one another from the opposite parts of the same units.

Figure 6:
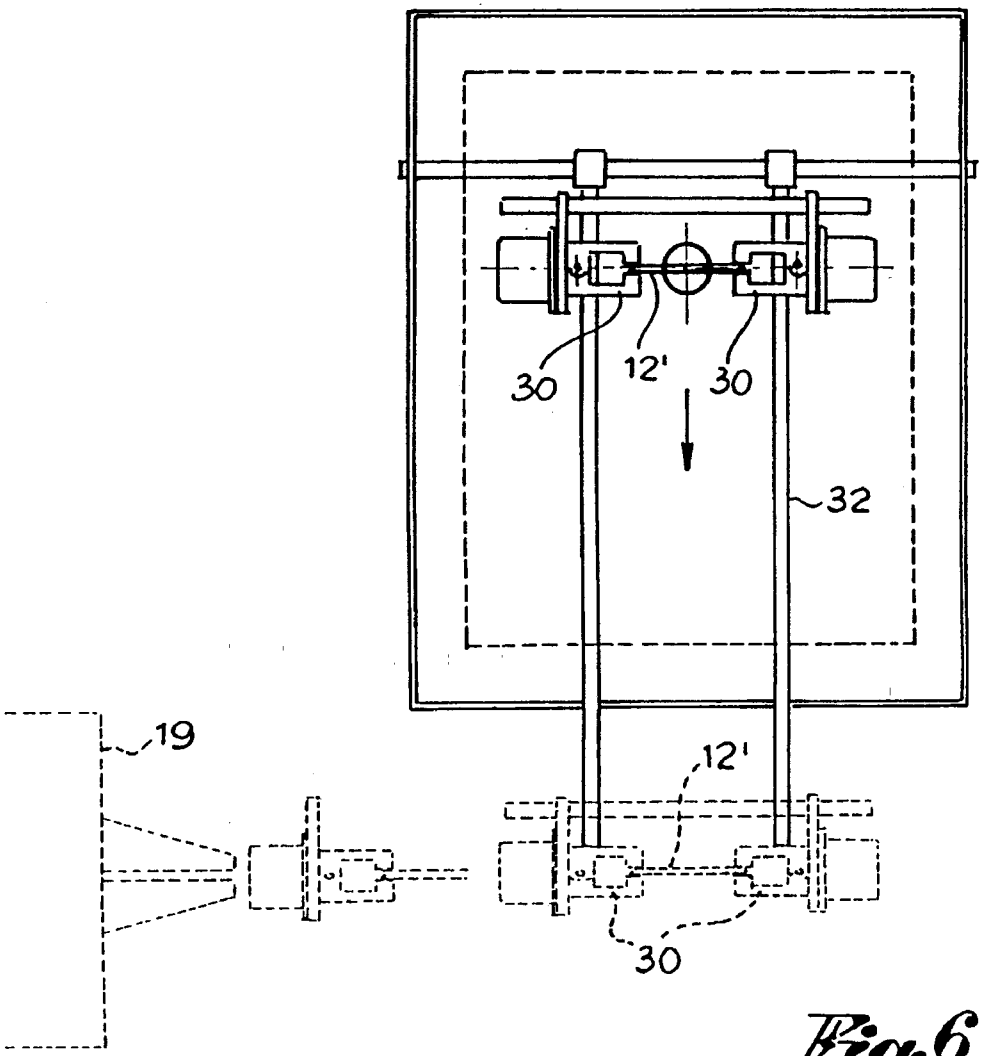
FIG. 6 is a reduced plan view according to the line VI—VI in FIG. 5 of the unit for transferring the stocking from the pickup device to a sewing machine.

Then, the stocking is held by the pincers 30 just below the conveying units 24, therefore by two opposite parts (see FIG. 6). Finally, the stocking is dropped by the conveying units 24 in order to be supported only by the pincers, which provide its transfer and positioning with respect to the sewing machine 19 for the closing of the toe.

Essentially, the pickup unit 21 eliminates the need for picking up and handling the manufactured products again, and mechanically turns these products inside out, while the pincers 30 are in a position to carry out the operation (using sewing machine 19) currently carried out manually by the machine employee for the closing of the toes of the stockings.

According to another embodiment of the present invention, the stocking 12 is removed and turned inside out above the cylinder 10 by previously raising, if necessary, the small plate 16 of the machine.

This embodiment is illustrated in FIGS. 7–10. It comprises, two special jacks 100 arranged in the rear of and in the same grooves with two diametrically opposite needles 11 on the cylinder of a circular machine. Further, two conveying units 101 capable of picking up a stocking 12 from the machine and transferring it to a sewing machine are provided.

Each special jack 100 can be moved independently of the needle 11, with which it is associated, between a lowered, inoperative position and a raised, operating position. The jack 100 has an upper hook 100' and a lower bead 100", which is at a lower level than the needle 11 (and lower than the lower needle usually aligned with this needle 11) for interacting with ascent and descent cams 110, which are provided, if necessary. When the jacks 100 are lowered, their upper hook 100' remains concealed and inactive behind the shank of the respective needles (see FIG. 9); when the jacks are raised, the upper hook 100' moves above the flat sinker into a position of intercepting the knitting (see FIG. 9*a*).

The conveying units 101 are supported by a support arm 102, which rotates with oscillation around a vertical axis 103 (see FIG. 7), or translates linearly, between a first position A and a second position B, the arm 102 being controlled for the movement from one position to another with appropriate means (not shown) depending on the rotating or translating mode of movement.

The two conveying units 101 are identical, mounted in line on the support arm 102, opposite from one another and both capable of linear movements of approaching and moving away from one another. Moreover, one of the conveying units 101 may also be moved independently of the other, while this other unit remains stationary, in order to be able to increase the distance between the two units.

Figures 7, 10, 10A:
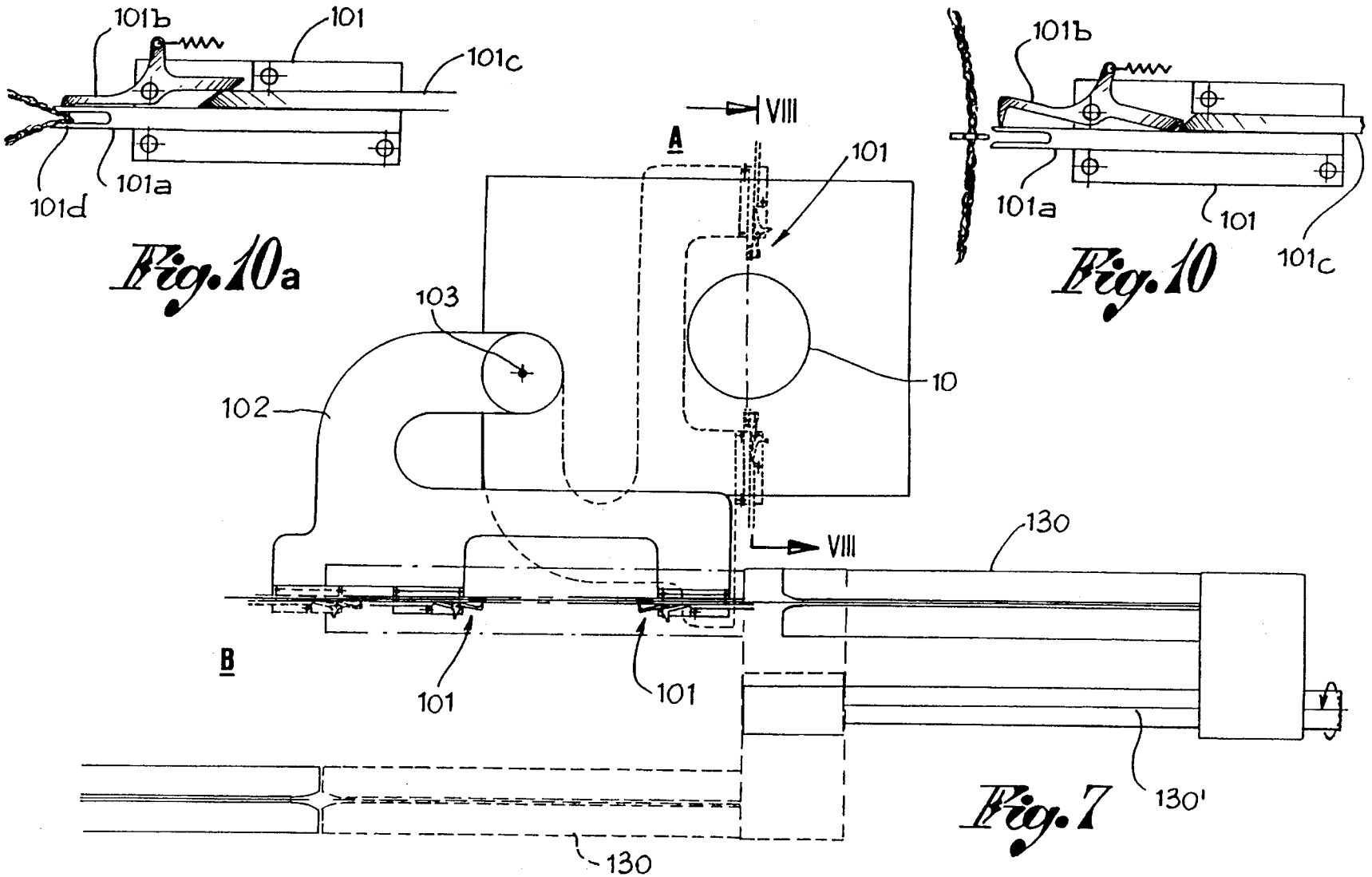
FIG. 7 is a plan view of a device according to the present invention for picking up each stocking above the cylinder of a circular machine.
FIG. 10 is a top view according to the line X—X in FIG. 9 with a conveying unit in the inoperative position.
FIG. 10*a* is a view similar to FIG. 10, but with the conveying units in the operating position.

When the support arm 102 is in the first position A, it is close to the cylinder 10 of the circular machine, and the conveying units 101 are located on two diametrically opposite parts of the cylinder as shown by dashed lines in FIG. 7. When the support arm 102 is in the second position B, it is away from the cylinder 10, and the conveying units 101 are arranged in line with at least one handling pincer 130, which pincer is associated with the sewing machine and which, if necessary, folds around a horizontal axis 130'.

Each conveying unit 101 comprises a forked element 101*a*, which faces the knitting to be taken hold of and is intended for being threaded radially from the outside towards the inside in the knitting itself, and a hook 101*b*, which rotates movably towards and away from the forked element 101*a* by means of, for example, a pushing element 101*c* (see FIGS. 10, 10*a*). The hook 101*b*, when it is brought close to the forked element, interacts with this element for taking hold of the knitting, with the hook preferably passing in holes 101*d* made in the arms of the forked element.

In addition, it should be noted that, corresponding to the position (B), in which the conveying units 101 come to lie when they are removed from the cylinder of the machine, a suction tube 136, which can be shifted in height and is intended for turning the stocking inside out, can be provided.

For picking up and removing a stocking above the cylinder 10 with the device described above, the procedure is as follows.

Figure 9A:
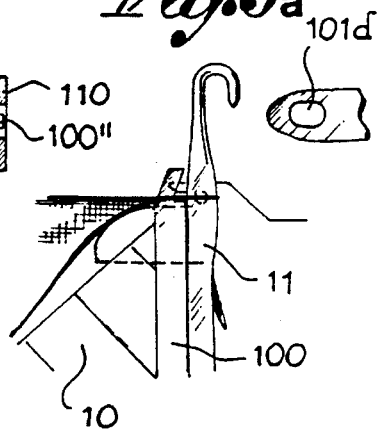
FIG. 9*a* is an enlarged detail view showing a stitch-collecting phase by special jacks.

Once the manufacture of the stocking 12 is completed at the level of the open toe 12', the two special jacks 100 are raised to half their height in order to hook up the corresponding stitches of the last rows of the "unthreading" stitches with their hook 100' (see FIG. 9*a*). Thus, the working outlet of the unthreading thread is controlled, and the needles are unloaded. The ring of the thread guides is raised, and with the cylinder rotating, the needles are made level with the knitting height typical of the machine.

Figure 9B:
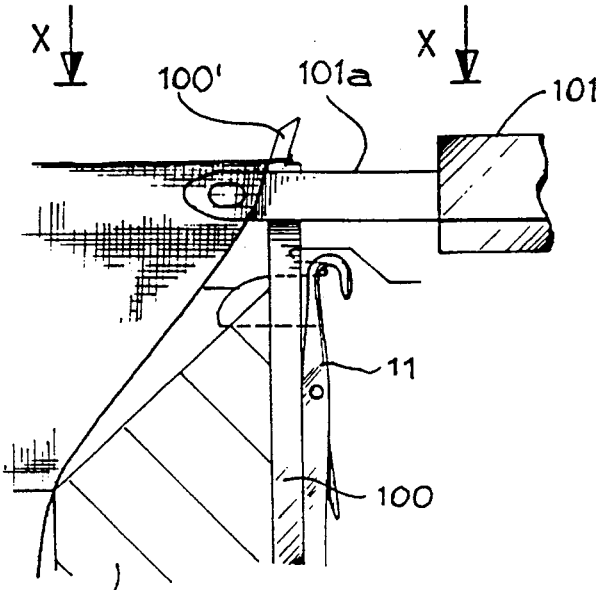
FIG. 9*b* is a view as in FIG. 9, but with the conveying units in the operating position.
Figure 9:
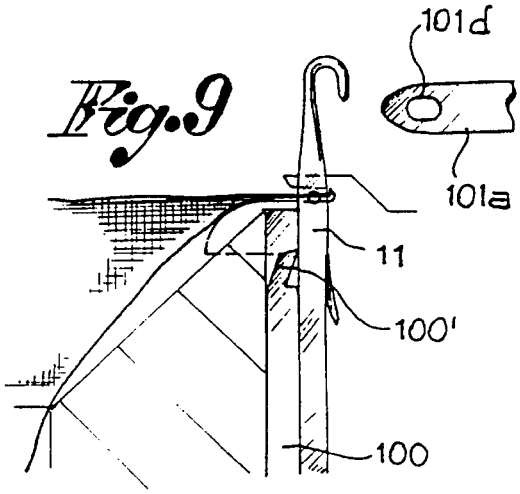
FIG. 9 is an enlarged detail view of FIG. 8 with the conveying units in the inoperative position.

At this point, the support arm 102 is moved into position A with the two conveying units 101, not operating, arranged on opposite sides of the cylinder. The special jacks 100 are raised high (see FIG. 9*b*), and the cylinder is stopped so that the jacks 100 are in correspondence with the conveying units 101. These units 101 are then moved forward so that the relative forked elements 101*a* embrace the jacks 100, being threaded in the "unthreading" stitch, after which the hook 101*b* is moved in order to intersect the forked element and to hook up the fabric. The two special jacks 100 are completely lowered so as to drop the manufactured product on the conveying units 101 (see FIG. 9). The arm, which supports these units, is thus moved away from the machine into the position B, making sure that the stocking is extracted along its entire length from the cylinder of the machine, and that it remains suspended on the conveying units 101. The machine can then be put back in operation to begin the manufacture of a new stocking.

Figure 11A:
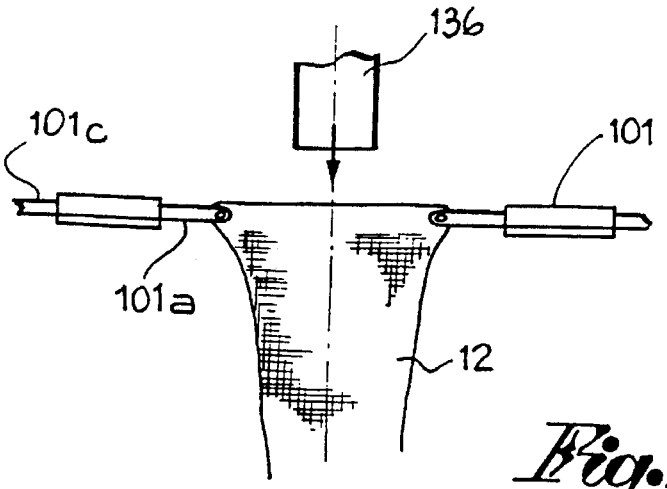
FIGS. 11*a*, 11*b*, and 11*c* are views showing a sequence of turning a stocking inside out when it is picked up above the cylinder.
Figure 11B:
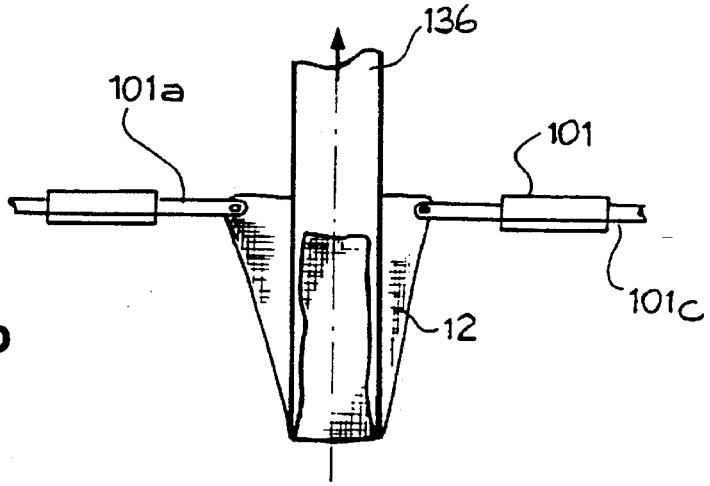
Figure 11C:
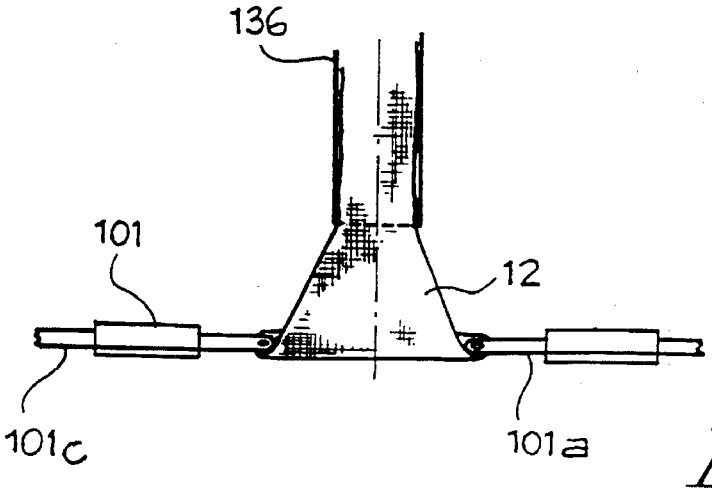

When the arm 102 is in the position B, the manufactured product is aligned under the turning-inside-out suction tube 136. This [arm]is lowered, without suction, inside the stocking up almost to the level of its edge, which is arranged at the bottom, after which, by applying a suction through the tube 136 and simultaneously raising same, the stocking is turned inside out, as shown in the sequence illustrated in FIGS. 11*a*, 11*b*, and 11*c*.

Once the stocking is turned inside out, one of the units is removed from the other so as to diametrically stretch the stocking at the level of its open toe in order to bring the open edges close to one another.

The conveying units 101, if possible, are then turned over, and the stocking is ejected from the turning-inside-out tube so as to become suspended on the units 101 and in a position to be held by at least one pincer 130 intended for carrying the stocking to the sewing machine after the stocking has been turned inside out by the conveying units through the opening of the hook 101*b* and the backward movement of the two conveying units 101.

At this point, the conveying units are ready for a next cycle of picking up and transferring of a new stocking from the machine, while the toe of the previous stocking is sewn, thus closed, in the sewing machine 19.

Figure 12:
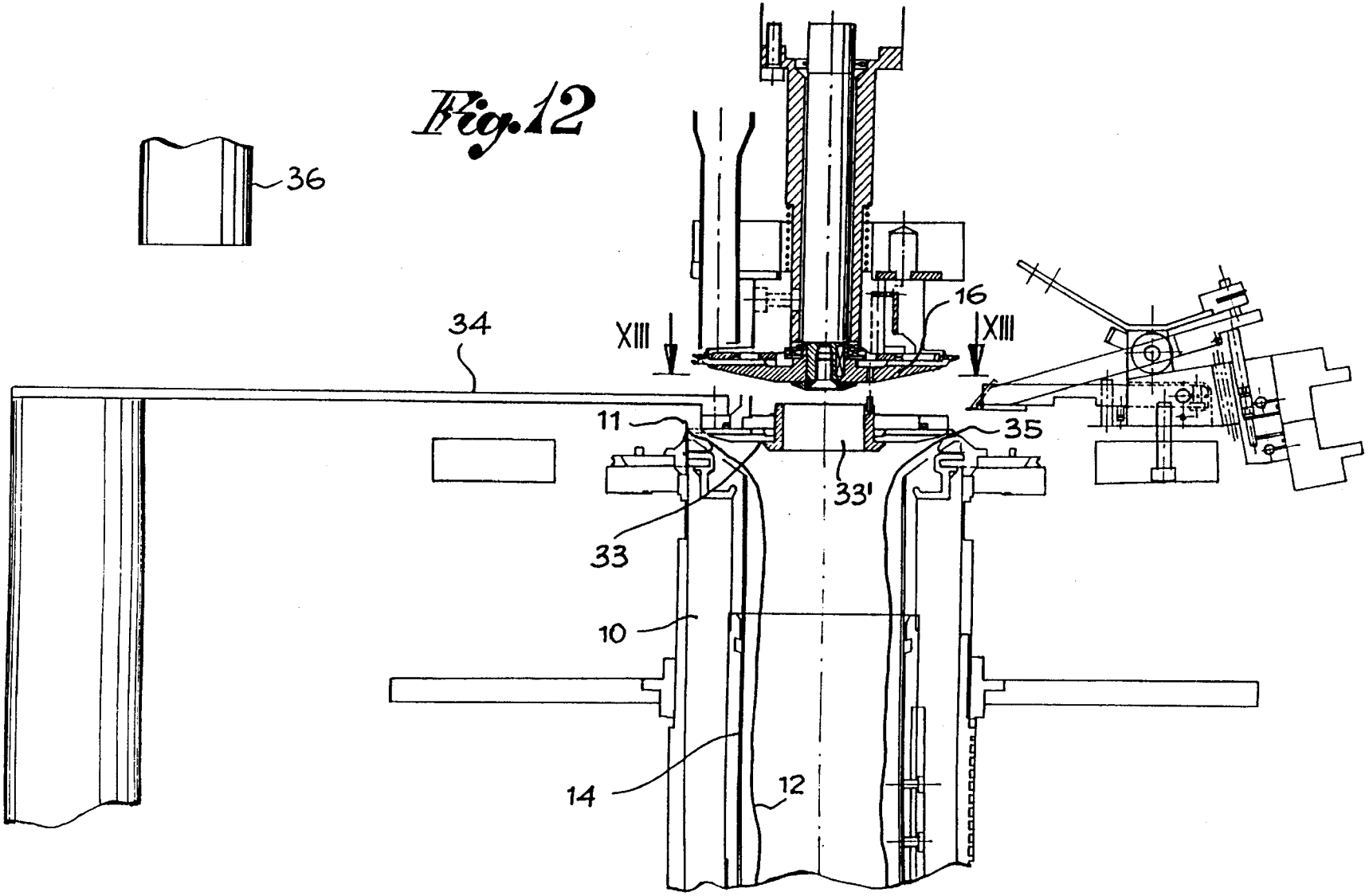
FIG. 12 is a partially sectional view showing part of a circular stocking knitting machine incorporating another embodiment of the device according to the present invention which is capable of picking up each stocking above the cylinder, the device being in an operating position.
Figure 15:
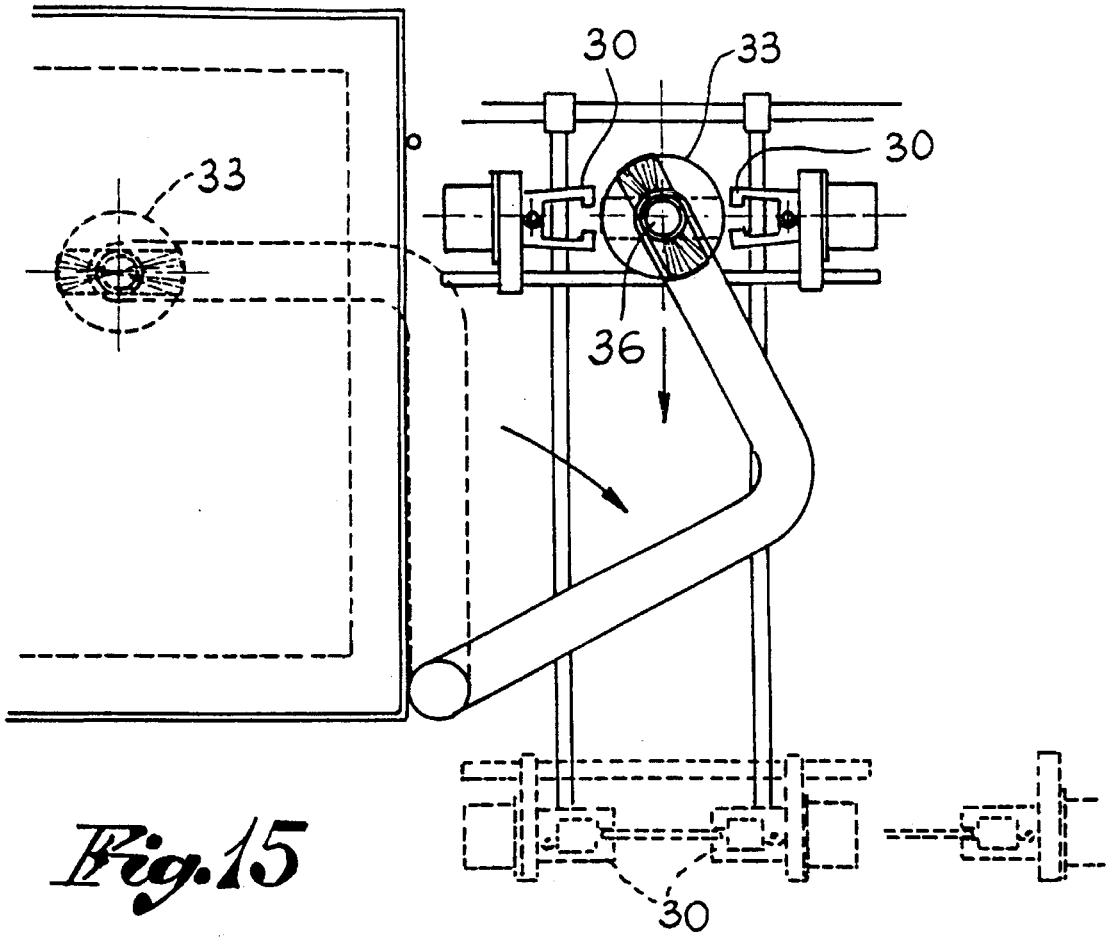
FIG. 15 is a plan view, which illustrates a unit for holding and transferring the stocking from the pickup device to a sewing machine.
Figure 13:
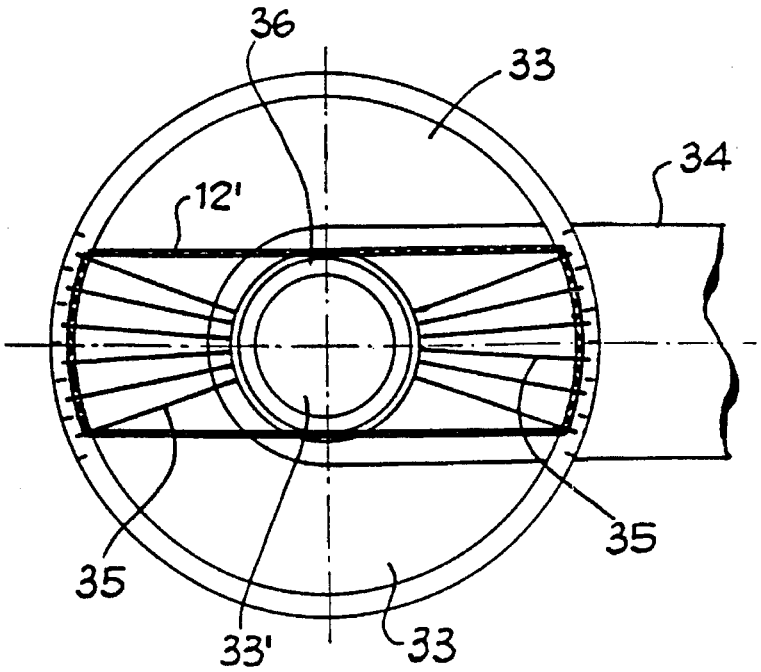
FIG. 13 is a view of the device according to the line XIII—XIII in FIG. 7.
Figure 14D:
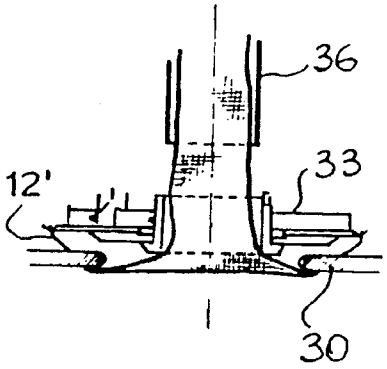
FIGS. 14*a*, 14*b*, 14*c*, and 14*d* are schematic views showing and in sequence, the phases of turning a stocking inside out within the scope of the device of FIG. 12.
Figure 14C:
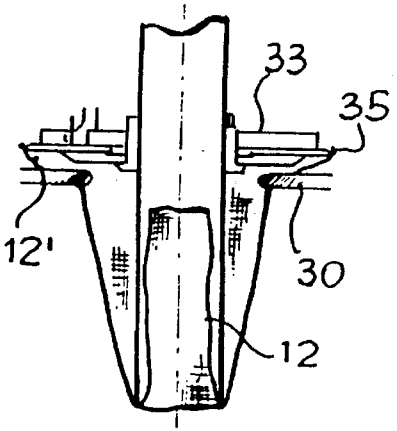
Figure 14B:
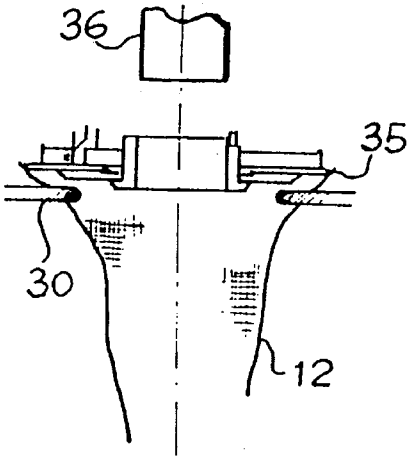
Figure 14A:
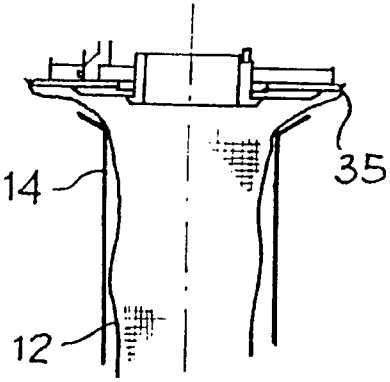
Figure 16:
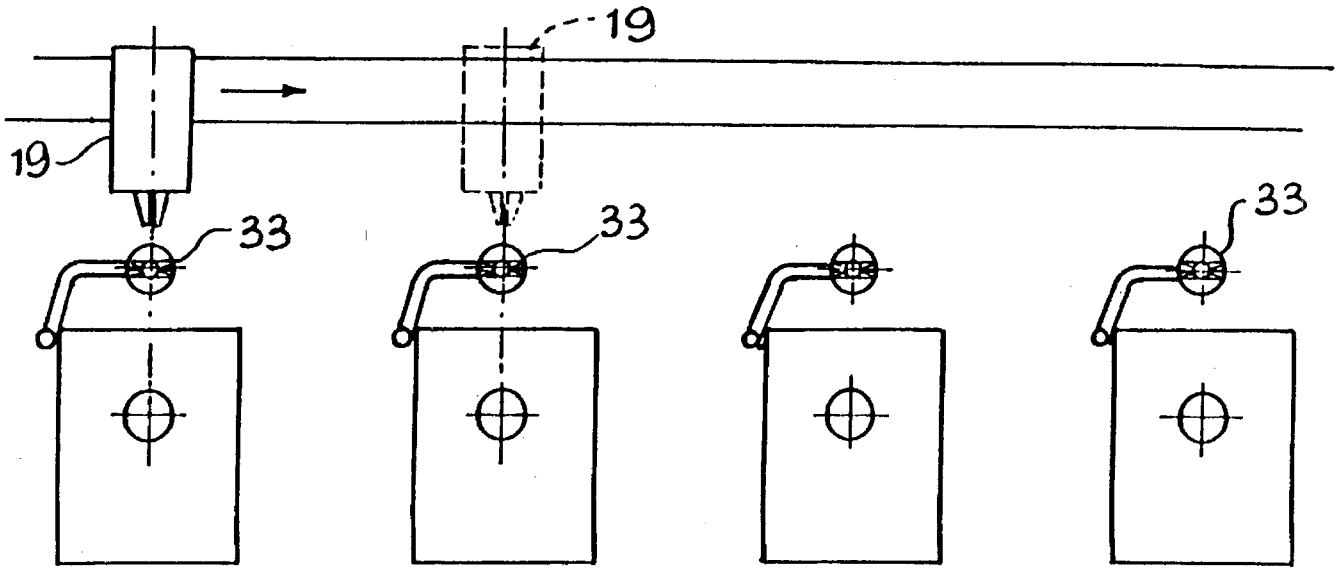
FIG. 16 is a diagram view of several circular machines served by a single sewing machine.

Also for an automated pickup of the stockings above the cylinder of the circular machine, another embodiment of the pickup device according to the present invention consists of an auxiliary pickup means 33, which is supported by a support arm 34 or by a guide means, which is movable from a position at a distance from the cylinder 10 to a position overlapping the cylinder, between this [cylinder]and the small plate of the machine (see FIGS. 12 and 16). Such movements are controlled by appropriate elements. The pickup means 33 has two diametrically opposite series, each with two, three or more conveying units 35 that are arranged radially and can be moved radially with appropriate means. In this case as well, the conveying units 35 may consist of latch type needles, piston type needles, hooks or the like.

A suction tube 36 for turning the stocking inside out, which tube can be moved vertically through a central hole 33' provided in the pickup means 33 to be introduced at least partially into the stocking 12 in order to turn it inside out, is provided in the position in which the pickup means 33 is when it is away from circular machine.

This pickup means from above also interacts with a transfer means with pincers 30, of the above-mentioned type, for conveying the stocking to the sewing machine 19.

The stocking is usually manufactured and is unfolded [in the pulling system]. The pickup means 33 is maintained at a distance from the circular machine, and the suction tube 36 is in the raised, inoperative position. When the stocking is completed in its open toe, the small plate 16 is raised, and the pickup means 33 is moved above the cylinder as in FIG. 12. The knitting is transferred by means of known techniques from some of the needles of the cylinder to the corresponding conveying units 35 on the pickup means 33, and it is then unloaded from all the needles of the cylinder, with which the stocking has been completed. Thus, the pickup means is removed from the machine, dragging the stocking along with it up to the suction tube 36. The suction tube 36 is then lowered into the stocking through the pickup means 33, and it is put into operation for suctioning towards the top and for turning the stocking inside out (see FIG. 14). In the same manner, the stocking is held by the pincers 30 on two opposite parts.

At this point, the stocking, turned inside out, is dropped by the pickup elements 35, remaining supported in two opposite zones by the pincers 30, which pincers 30 provide for transferring and for positioning the manufactured product in the sewing machine 19 for the closing of the open toe of the stocking.

In the above description, the pincers 30, 130 for holding and for introducing the stockings into the sewing machine have been described as guided and movable towards the sewing machine, which remains stationary. This sewing machine may be provided for serving one, two or more circular machines, from which the stockings come. However, this does not rule out the fact that the sewing machine or seam cutter may itself be movable on grounded guides or be suspended (see FIG. 16) and movable towards the circular machines, to which it is subject with a computerized control system.

While specific embodiments of the invention have been shown and described in detail to illustrate the application of the principles of the invention, it will be understood that the invention may be embodied otherwise without departing from such principles.

What is claimed is:

1. A process for transferring a stocking from a stocking knitting machine to a sewing machine, for closing the toe of the stocking, comprising:

manufacturing each stocking starting from a cuff and ending at a toe location of the stocking, the stocking at said toe location remaining open;

mechanically removing the stocking from the knitting machine by picking up the stocking from needles of a needle cylinder of the machine, using two parts of the stocking which are diametrically opposite on the stocking;

supporting the stocking by the two opposite parts;

bringing two opposite parts together; and transferring the stocking to the sewing machine for closing the toe of the stocking.

2. A process according to claim 1, further comprising:

providing a pulling system in the knitting machine for pulling the stocking during knitting;

mechanically picking up each stocking by extracting the stocking from below the cylinder of the knitting machine including passing the pulling system through the cylinder of the knitting machine.

3. A process according to claim 1, wherein the stocking is mechanically picked up and is extracted from the cylinder of the knitting machine.

4. A process according to claim 1, wherein the step of picking up the stocking comprises:

each stocking being picked up from needles of the cylinder of the knitting machine by passage of two mechanically conveying elements through a corresponding two diametrically opposite stitch points from two respective needles;

unloading the stitch points from the needles of the cylinder of the knitting machine for turning the stocking inside out;

removing the stocking from the cylinder using conveying elements to support the stocking at two locations, the conveying elements being in an inactive position during the manufacture of the stocking and being brought into an active position for said picking up the stocking from the needles, after manufacture of the stocking.

5. A process according to claim 4, further comprising:

bringing together edges of the open toe location of the stocking for their sewing by pressing the stocking on two opposite parts adjacent to the conveying elements; and releasing the conveying elements from the stocking when the edges of the toe have been brought together.

6. A process according to claim 3, wherein:

each stocking includes stitch points which form edges of the open toe location;

providing a pulling apart means with a pulling apart needle located above the cylinder for pulling apart said diametrically opposite parts of the stocking;

said picking up of the stocking from the needles is performed after said stitch points have been transferred from the needles of the cylinder to the needles of the pulling-apart means;

taking hold of the stocking on two diametrically opposite parts 9f the stocking;

unloading all the stitch points from the needle of the pulling-apart means in order to unload the stocking so that it may be transferred to the sewing machine while it is held on the two opposite parts and while the edges of the open toe location are brought together in order to be able to be sewn.

7. A device for picking up and for transferring a stocking with an open toe from a circular stocking knitting machine is manufacturing the stocking, to a sewing machine for closing of the toe of the stocking, the stocking being manufactured with needles of a cylinder and of a small plate of the circular knitting machine by starting from a cuff and ending in the open toe and being released from manufacture in a pneumatic pulling system, the device comprising:

conveying unit means for taking hold of the stocking in at least two opposite zones of its knitted fabric at a level of the open toe before the stocking is unloaded from the needles of the knitting machine;

means for the movement of the conveying units between a position (A) for picking up the stocking in the circular machine and a position (B) outside the circular knitting machine; and holding means for taking hold of the stocking from the conveying unit means when the conveying unit means is adjacent to the position (B) outside the circular machine, for bringing edges of the open toe of the stocking together, for maintaining the edges together and for positioning the stocking with respect to the sewing machine for the closing of the toe.

8. A device in accordance with claim 7, provided for the pickup of the stocking below the cylinder of the circular knitting machine, the device further comprising:

a central guide tube arranged and extending axially to the pulling system;

pickup head means, movable vertically in the central guide tube between a lowered position outside the pulling device and the central tube and a raised position at a level of the needles of the cylinder for picking up the stocking at the level of the open toe from the needles of the cylinder to turn the stocking inside out and to extract it below the guide tube;

the conveying unit means including two opposite conveying units mounted on the pickup head means intended for receiving two opposite zones of the toe of the stocking from the needles of the cylinder when the pickup head means is in the raised position; and means for the support of the conveying unit means on the pickup head means with the conveying unit means being moved at angles between a position of bringing together at the center during the passage of the pickup head means in the guide tube and a spread-apart position for the pickup of the stocking from the needles of the cylinder when the pickup head is in the raised position, and for bringing the edges of the open toe of the stocking close together when the pickup head is in the lowered position, with the holding means for holding the stocking for its positioning with respect to the sewing machine being at the level of the pickup head means when the pickup head means is in the lowered position.

9. A device in accordance with claim 8, wherein;

the pickup head means carrying the conveying unit means is arranged vertically movable with a rod of a pneumatic piston;

angular movements of the conveying unit means are controlled by edge pistons positioned on an edge of the pickup head means.

10. A device in accordance with claim 7, provided for the pickup of the stocking above the cylinder of the circular machine, further comprising:

two opposite conveying units forming said conveying unit means;

an arm, the two opposite conveying units being supported by the arm and being movable from a first position, in which the units are arranged radially outside and adjacent the cylinder of the machine, to a second position, in which the units are at a distance from the machine, the two opposite conveying units being mounted on the arm;

separate edge elements each included with a separate one of the conveying unit means for hooking knitting of the stocking on the needles of the cylinder in two diametrically opposite zones;

means for moving the arm from the first position to the second position for complete extraction of the stocking from the cylinder of the machine when the stocking is unloaded from the needles of the knitting machine;

suction means for turning the stocking inside out while it is hooked to the conveying units; and a holding pincer for picking up the stocking from the conveying unit means and for sending it to the sewing machine when the arm is in the second position.

11. A device in accordance with claim 10, wherein the conveying units, each include a forked element for radially threading in the knitting of the stocking and a hook for hooking the knitting to the forked element, the units being movable mutually towards and away from one another and rotating on an axis passing through the two aligned units.

12. Device in accordance with claim 7, provided for a pickup of the stocking above the cylinder of the circular machine between the cylinder and a small plate of the circular knitting machine, further comprising:

auxiliary pickup means;

a support arm, the auxiliary pickup means being supported by the support arm and being movable between a lateral position away from the cylinder with needles of the circular knitting machine and an overlapping position overlapping, and coaxially to the cylinder of the machine, between the cylinder and the small plate; and the conveying unit means includes two opposite sets of conveying units, which are mounted and can move radially on the pickup means, conveying units for picking up the stocking from the needles of the cylinder when the pickup means is in a position of overlapping the cylinder and for releasing the stocking to the holding means when the pickup means is moved laterally, away from the cylinder.

13. A device with claims 10, wherein the suction tube is vertically movable through the pickup means when the stocking is being turned inside out.

14. A device in accordance with claims 12, wherein the suction tube is vertically movable through the pickup means when the stocking is being turned inside out.

15. A device in accordance with claim 7, further comprising means for moving the holding means towards and away from the sewing machine.

16. A device in accordance with claim 7, further comprising means for moving the sewing machine relative to the holding means and relative to the circular machines.

17. A process for transferring a stocking from a stocking knitting machine to a sewing machine, the process comprising the steps of:

providing a stocking on a knitting machine with an open toe portion engaged by needles of the knitting machine;

mechanically grasping two diametrically opposite parts the open toe portion of the stocking while the open toe portion is engaged by the needles;

removing said two diametrically opposite parts of the open toe portion from the needles of the knitting machine in a manner to remove all of the toe portion from the needles;

moving the entire stocking out of, and away from, the knitting machine and toward a sewing machine;

supporting the entire stocking by said two diametrically opposite parts of the toe portion during said moving;

moving said diametrically opposite parts of said toe portion in directions away from each other to close the open toe portion into a shape where the closed toe portion can be sewn closed by the sewing machine.

* * * * *